United States Patent [19]

Weems et al.

[11] 4,252,325

[45] Feb. 24, 1981

[54] HUNTING ARROW

[76] Inventors: John R. Weems, 607 Edgewood Dr.; Larry F. Smith, 1408 Frey Ave., both of Sheffield, Ala. 35660

[21] Appl. No.: 80,139

[22] Filed: Sep. 28, 1979

[51] Int. Cl.[3] ..... F41B 5/02

[52] U.S. Cl. ..... 273/416

[58] Field of Search ..... 273/416, 418, 419, 420, 273/421, 422, 423; 43/6

[56] References Cited

U.S. PATENT DOCUMENTS 3,993,311 11/1976 Johnson ..... 273/420

*Primary Examiner*—Paul E. Shapiro

*Attorney, Agent, or Firm*—Woodford R. Thompson, Jr.

[57] ABSTRACT

A hunting arrow that causes a continuation of the bleeding in wounded game. The arrow embodies a hollow shaft having a forward end and a rearward end with an arrow mounted at the forward end and a nock mounted at the rear end thereof. A length of high strength line within the hollow shaft is fixedly connected at one end to the rearward end of the shaft and the other end of the line is fixedly connected to the arrowhead so that in the event the hollow shaft is broken the line still interconnects and limits relative movement of the broken parts of the shaft whereby they move along with the arrowhead and the game.

6 Claims, 5 Drawing Figures

HUNTING ARROW

BACKGROUND OF THE INVENTION

This invention relates to a hunting arrow that will cause a continuation of the bleeding in wounded game thus aiding in the tracking and recovery of the game by the hunter.

As is well known in hunting game, such as deer, the wounded game often runs a great distance before it falls and dies due to the fact that the arrow shaft is broken into as the game runs through wooded areas whereby the arrow shaft is separated from the arrowhead and the game. That is, when the shaft is broken into as the game runs through wooded areas, the shaft is pulled from the game and falls to the ground thereby permitting the wound to close and thus prevent further bleeding from the wound. When bleeding from the wound is thus stopped, the hunter can no longer track the game due to the fact that there is no blood trail left by the game. Also, since there is no further loss of blood after the wound is closed, the game can run a much greater distance than it can where the wound remains open and the game bleeds freely.

Heretofore in the art to which our invention relates, many attempts have been made to overcome the above mentioned problems encountered in recovering and tracking wounded game. One attempt has been to inject a tranquilizing fluid into the game to prevent the wounded game from traveling very far, such as shown in U.S. Pat. No. 3,066,940. Also various type arrowheads have been provided which bring about fatal hemorrhaging of wounded game in a relatively short time. Also, arrows have been provided with bobbins which dispense a continuous length of yarn after the arrow is embedded in the game whereby the yarn is unraveled and leaves a trail which may be tracked. Also, the Johnson U.S. Pat. No. 3,993,311 discloses a hunting arrow which embodies telescoping hollow shafts which are mounted for sliding movement relative to each other with a nock friction fitted in the outermost shaft. A short length of line is connected to the nock and to the arrowhead whereby upon impact with the game, the outer shaft will slide forward causing the rear end of the inner shaft to dislodge the nock from the outer shaft, whereby it falls to the ground and becomes entangled in brush to thus pull back on the arrowheads. As the arrowhead is pulled back through the game, the rear cutting edges of the arrow cause massive hemorrhaging.

SUMMARY OF THE INVENTION

To overcome the above and other difficulties, we provide a hunting arrow which embodies a hollow shaft having an arrowhead mounted at the forward end thereof and a nock mounted at the rearward end thereof. A length of high strength line is provided within the hollow shaft with one end of the line being fixedly connected to the hollow shaft adjacent the rearward end thereof. The other end of the line is connected to the arrowhead so that in the event the hollow shaft is broken the line still interconnects the broken parts of the hollow shaft to each other and limits movement of the broken parts relative to each other so that the broken parts move along with the arrowhead. Accordingly, the hollow shaft remains in the wound caused by the arrow even though the hollow shaft of the arrow is broken whereby the broken parts of the hollow shaft continuously agitate the wound as the game continues to run, thus causing a continuation of the bleeding in the wounded game. That is, the broken parts of the hollow shaft of the arrow remain closely adjacent each other whereby they remain in contact with the wound caused by the arrowhead to thus bring about continuous agitation of the wound whereby it remains open and the game continues to bleed freely at the wound.

DESCRIPTION OF THE DRAWING

A hunting arrow embodying features of our invention is illustrated in the accompanying drawing, forming a part of this application, in which.

DETAILED DESCRIPTION

Figure 1:
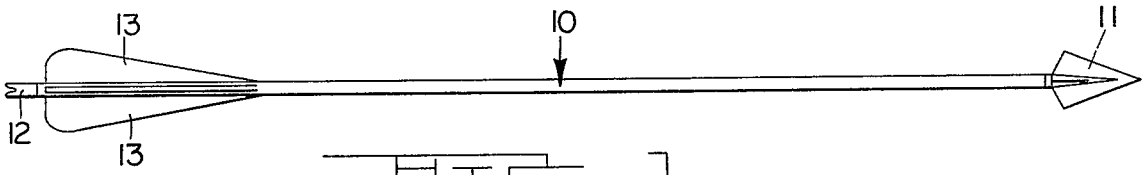
FIG. 1 is a side elevational view of our improved arrow as viewed prior to shooting.
Figure 2:
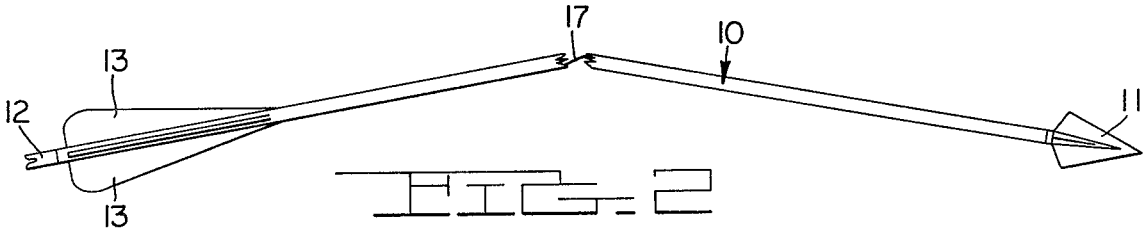
FIG. 2 is a side elevational view of the arrow shown in FIG. 1 showing the hollow shaft of the arrow broken into parts.

Referring now to the drawing for a better understanding of our invention, we show an elongated hollow shaft 10 having an arrowhead 11 mounted at the forward end thereof and a nock 12 mounted at the rearward end thereof. Suitable fletching vanes or flight guiding feathers 13 extend radially and outwardly from the rear portion of the hollow shaft, as shown. The hollow shaft 10 may be formed of a suitable material, such as aluminum, fiberglass, or the like. Also, the arrowhead 11 may be of a conventional type which has side or rear cutting edges 14 and 16, respectively.

Figure 3:
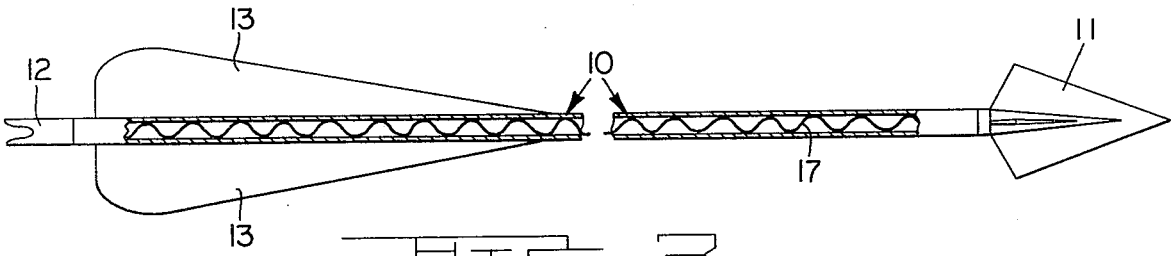
FIG. 3 is an enlarged view of portions of the arrow shown in FIG. 1 showing parts broken away and in section.
Figure 4:
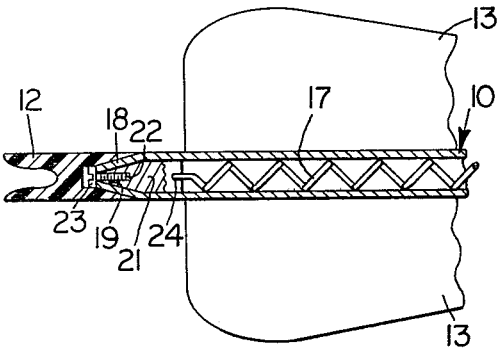
FIG. 4 is an enlarged, fragmental sectional view showing the manner in which the high strength line is fixedly connected at one end to the rearward end of the hollow shaft; and, FIG. 5 is a fragmental, sectional view showing the manner in which the high strength line is connected to the arrowhead.
Figure 5:
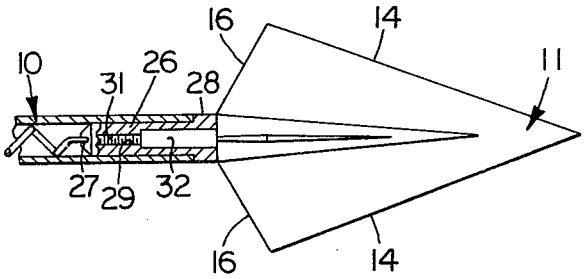

A length of high strength line 17 extends within and substantially the length of the hollow shaft 10, as shown in FIGS. 3, 4 and 5. The rearward end of the hollow shaft 10 is shown as being tapered rearwardly as at 18 to provide a reduced diameter having an axially extending opening 19 therethrough. As shown in FIG. 4, one end of the high strength line 17 is connected to an insert 21 which is mounted within the hollow shaft 10 and is provided with a rearwardly tapered end portion which corresponds generally to the tapered end portion 18. A threaded opening 22 is provided in the insert 21 for receiving an externally threaded retainer member 23. The retainer member 23 may be in the form of a small bolt, screw or the like having a head which engages the rearward end of the hollow shaft 10 upon inserting the retainer member 23 through the axially extending opening 19 and into threaded engagement with the insert 21. A transverse opening 24 is provided through the forward portion of the insert 21 for receiving the rearward end of the high strength line 17 whereby the rearward end of the high strength line 17 is fixedly connected to the insert 21 which in turn is fixedly secured to the rearward end of the hollow shaft 10. Accordingly, the rearward end of the high strength line 17 is fixedly secured to the rearward end of the hollow shaft 10 by the insert 21. After securing the rearward end of the high strength line 17 to the rearward end of the hollow shaft 10, the nock 12 is inserted over the rearwardly tapered portion 18 and secured thereto by suitable means, such as an adhesive or the like.

The other or forward end of the high strength line 17 is shown as being connected to the arrowhead 11 by a sleeve-like member 26 which telescopes into the forward end of the hollow shaft 10, as shown in FIG. 5. A transverse opening 27 is provided through the rear end of the sleeve-like member 23 for attaching the forward end of the high strength line 17. Also, the rearward end of the sleeve-like member 26 may be tapered, as shown, to facilitate insertion into the hollow shaft 10. An enlarged diameter collar 28 is provided at the forward end of the sleeve-like member 26 in position to engage the forward end of the hollow shaft 10. An axially extending threaded opening 29 is provided in the sleeve-like member 26 for receiving a threaded portion 31 of an elongated member 32 which is carried by the arrowhead 11, as shown in FIG. 5.

The length of high strength line may be formed of a suitable material, such as high strength wire, which permanently connects the arrowhead 11 to the rearward end of the hollow shaft 10. Preferably, the high strength line 17 is coiled, as shown, with the outer surface of the coils engaging the inner surface of the hollow shaft 10 for absorbing sound vibrations. While the Tengel U.S. Pat. No. 1,999,601 discloses an arrow having sound-absorbing means associated therewith, the sound-absorbing means is in the form of corrugated paperboard, or the like.

From the foregoing description, the operation of our improved hunting arrow will be readily understood. The rearward end of the high strength line 17 is fixedly connected to the rearward end of the hollow shaft 10 while the other or forward end of the high strength line 17 is secured to the arrowhead 11 carried by the forward end of the hollow shaft 10. In the event the hollow shaft 10 is broken after the arrowhead 11 passes into or through the game, the high strength line 17 will still interconnect and limit movement of the broken parts of the hollow shaft 10 relative to each other whereby a part or parts of the broken arrow will remain in contact with the wound, thus continuously agitating the wound whereby the wound would not be closed and thus stop the flow of blood therefrom. It will thus be seen that we have provided an improved hunting arrow which not only facilitates tracking of the game which has been struck with an arrow but also greatly reduces the time required for wounded game to bleed to death. Furthermore, my improved hunting arrow causes a constant agitation of the wound to thus assure continuous bleeding even though the arrow is broken into parts.

While I have shown my invention in but one form, it will be obvious to those skilled in the art that it is not limited, but is susceptible of various changes and modifications without departing from the spirit thereof.

What we claim is:

1. A hunting arrow comprising:

(a) a hollow shaft having a forward end and a rearward end, (b) an arrowhead mounted at the forward end of said hollow shaft, (c) a nock mounted at the rearward end of said hollow shaft, (d) a length of high strength line within said hollow shaft, (e) means fixedly connecting one end of said line to said hollow shaft adjacent the rearward end thereof, and (f) means connecting the other end of said line to said arrowhead so that in the event said hollow shaft is broken said line still interconnects and limits movement of the broken parts of said hollow shaft relative to each other whereby said broken parts move along with said arrowhead.

2. A hunting arrow as defined in claim 1 in which said means connecting all other end of said line to said arrowhead comprises a sleeve-like member telescopically engaging said forward end of said hollow shaft and connected to said other end of said line and to said arrowhead.

3. A hunting arrow as defined in claim 2 in which said sleeve-like member extends inwardly to said forward end of said hollow shaft and an enlarged diameter collar at the forward end of said sleeve-like member engages said forward end of said hollow shaft with said other end of said line being connected to the rear end of said sleeve-like member and said arrowhead being connected to the forward end of said sleeve-like member.

4. A hunting arrow as defined in claim 1 in which said means fixedly connecting said one end of said line to the rearward end of the said hollow comprises, (a) an insert mounted within said hollow shaft adjacent said rearward end thereof, (b) said rearward end of said hollow shaft having a reduced diameter portion with an axially extending opening therethrough, and (c) an externally threaded retainer member engaging said rearward end of said hollow shaft and extending forwardly through said opening and into threaded engagement with an internally threaded opening in said insert.

5. A hunting arrow as defined in claim 1 in which said length of high strength line is a wire member.

6. A hunting arrow as defined in claim 1 in which said length of high strength line is coiled with the outer surfaces of the coils thereof engaging the inner surface of said hollow shaft for absorbing sound vibrations.

* * * * *